US006106706A

United States Patent [19]

Roy et al.

[11] Patent Number: 6,106,706

[45] Date of Patent: Aug. 22, 2000

[54] STORM WATER FILTER ARRANGEMENT

[75] Inventors: Scott Wade Roy; Richard John Versteegh, both of South Australia, Australia

[73] Assignee: RSF Patent Pty Ltd., Hawthorndene, Australia

[21] Appl. No.: 09/068,057

[22] PCT Filed: Oct. 30, 1996

[86] PCT No.: PCT/AU96/00677

§ 371 Date: Apr. 29, 1998

§ 102(e) Date: Apr. 29, 1998

[87] PCT Pub. No.: WO97/16609

PCT Pub. Date: May 9, 1997

[30] Foreign Application Priority Data

| | | | |
|---|---|---|---|
| Oct. 30, 1995 | [AU] | Australia | PN6230 |
| Feb. 26, 1996 | [AU] | Australia | PN8253 |
| Jun. 12, 1996 | [AU] | Australia | PO0381 |
| Jul. 10, 1996 | [AU] | Australia | PO0918 |
| Jul. 12, 1996 | [AU] | Australia | PO0977 |

[51] Int. Cl.[7] ..... E03F 5/042; E03F 5/06

[52] U.S. Cl. ..... 210/99; 210/130; 210/136; 210/164; 404/4

[58] Field of Search ..... 210/99, 130, 136, 210/170, 163, 164, 165, 232; 404/4; 52/12

[56] References Cited

U.S. PATENT DOCUMENTS

| | | |
|---|---|---|
| 1,292,289 | 1/1919 | Fleek . |
| 4,419,232 | 12/1983 | Arntyr et al. . |
| 5,049,263 | 9/1991 | Hoffman et al. . |
| 5,223,154 | 6/1993 | Macpherson et al. . |
| 5,405,539 | 4/1995 | Schneider . |
| 5,634,299 | 6/1997 | Gaston . |

FOREIGN PATENT DOCUMENTS

| | | |
|---|---|---|
| 636751 | 2/1995 | European Pat. Off. . |
| 637653 | 2/1995 | European Pat. Off. . |
| 6-306925 | 11/1994 | Japan . |
| 1218934 | 1/1971 | United Kingdom . |
| WO 88/03201 | 5/1988 | WIPO . |

OTHER PUBLICATIONS

Patent Abstract of Japan, M–953, p. 14, JP,A, 2–13622, Mitsubishi Plastics Ind Ltd, Jan. 18, 1990.

*Primary Examiner*—David A. Simmons
*Assistant Examiner*—Fred Prince
*Attorney, Agent, or Firm*—Klauber & Jackson

[57] ABSTRACT

A filter apparatus for filtering gross pollution from storm water for fitment to storm water traps located at the entry and exit of storm water, underground and drainage systems. The apparatus includes a gross pollution filter basket located below the entry level of storm water into the trap so as to provide a bypass channel to allow a volume of storm water to pass through the trap. SA storm water bypass means is arranged to restrict entry of incoming storm water and gross pollution into the bypass channel while the combined pressure of storm water and gross pollution inside the trap is such that storm water can still pass through the filter basket.

The bypass means which acts like a one-way valve is also arranged to allow storm water and gross pollution to pass into the bypass channel when the combined pressure of storm water and gross pollution inside the trap is such that the storm water is restricted from passing through the filter basket.

8 Claims, 6 Drawing Sheets

STORM WATER FILTER ARRANGEMENT

This invention relates to storm water filtration and in particular to the filtering of gross pollution from storm water at its entry or exit from the storm water, underground and drainage systems.

BACKGROUND

Water quality degradation is a problem of growing proportions. One measure of water quality is the amount of gross pollution that is carried from our roads and streets into our storm water system and eventually into the reservoirs that we rely on for potable water, our rivers and ultimately the ocean.

Gross pollution in the main (90%) comprises organic matter like branches, twigs, leaves, and soil, the remainder being nonorganic matter like plastic containers, bags, wrappers; paper; cans; and cigarette butts.

In metropolitan and township areas storm water catchment consists of road surfaces and the entry points for storm water into the underground portion of a storm water drainage system consists of one or more gully traps located along the sides of the road surfaces. There exist different types of gullies, the side entry and the surface grate being the two most common.

Serious academic and practical studies of road surface, curb and channel design relating to road usage and safety are combined with gully trap configuration (eg depression, grate, deflector, etc) studies to provide the optimum means by which to trap storm water, and the inevitable gross pollution carried by it, and directed into the drains below the road surface.

Such traps are designed to operate effectively in a range of storm water run off conditions including low flow to very high flow which ideally captures 100% of the flow but otherwise minimises the bypass of water and pollutants downstream of the trap.

Regardless though of the effectiveness of the traps, the problem identified by the inventors was how to effectively filter the full range of flows of water and prevent the entry of gross pollution into the underground storm water drainage systems without affecting the efficiency of the traps.

One approach to the solution of this problem is disclosed in U.S. Pat. No. 5,232,587 which describes the use of a two stage grate filter arrangement which in theory is meant to provide a path of least resistance to the storm water just internal and slightly below the entrance to the trap by providing a multi aperture grate and beyond that a further grate with larger apertures located rearward and internal of the trap opening.

As gross pollution of a size unable to pass through the grates builds up, the resistance to flow through the grates increases and it is soon found that the efficiency of the trap diminishes as is evidenced by the increasing amount of bypass flow. Eventually, the grates become covered with gross pollution and the trap is no longer useful. The volume of gross pollutants needed to produce this effect is quite small since the grates are located just below the road surface level which therefore necessitates frequent cleaning to maintain trap efficiency.

Thus the invention is directed to overcoming the problems described above while also reducing the maintenance commitment.

BRIEF DESCRIPTION OF THE INVENTION

In a broad aspect of the invention a gross pollution filter apparatus for placement within a trap arrangement used in a storm water drainage system comprises a filter basket located below the entry level of the storm water into the trap arrangement, the basket being adapted to prevent gross pollution passing into the trap arrangement, and the basket also being located so as to provide a bypass channel to allow a volume of storm water to pass through the trap arrangement, and a storm water bypass being arranged to restrict entry of incoming storm water and gross pollution into said bypass channel while the combined pressure of storm water and gross pollution inside the trap arrangement is such that storm water can pass through the filter basket but which is also arranged to allow storm water to pass into the bypass channel when the combined pressure of storm water and gross pollution inside the trap arrangement is such that the storm water is restricted from passing through the filter basket.

In a further aspect of the invention the trap arrangement comprises a side entry pit and the filter basket is located in the pit opposite the entry point of the storm water and the storm water bypass means is located across the top of the bypass channel which is located between the entry point of the storm water and the filter basket In a yet further aspect of the invention the storm water bypass means is a one way valve means.

Specific embodiments of the invention will now be described in some further detail with reference to and as illustrated in the accompanying drawings. These embodiments are illustrative, and are not meant to be restrictive of the scope of the invention.

DETAILED DESCRIPTION OF EMBODIMENTS OF THE INVENTION

Road surfaces collect or are the primary collection area for storm water in townships and metropolitan areas. A plurality of storm water traps are located along the sides of roadways so as to facilitate the collection of storm water and the redirection of that storm water into underground storm water drainage systems which also occasionally use above ground water ways to communicate storm water to reservoirs and/or the ocean.

Figure 3:
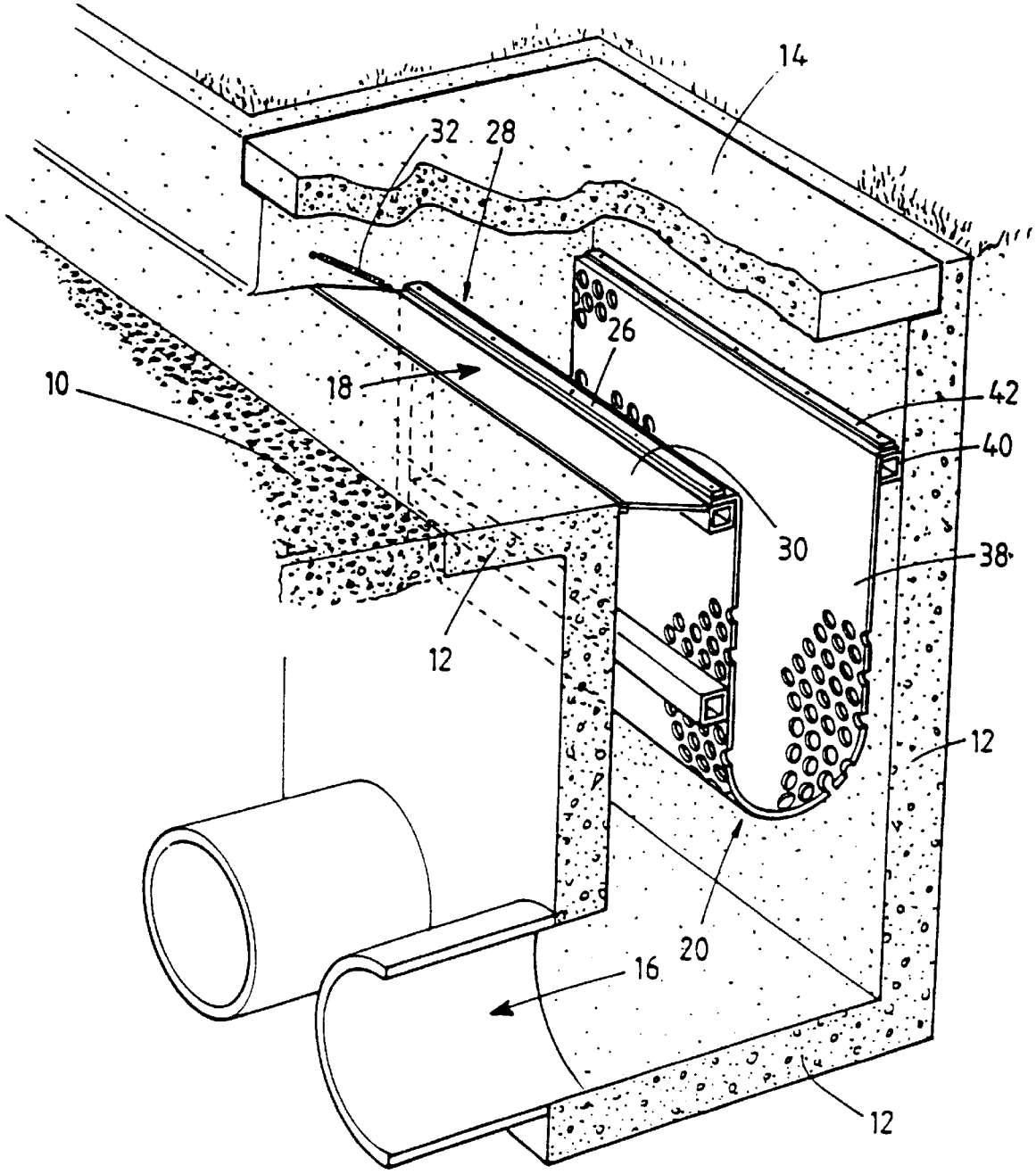
FIG. 3 depicts a perspective view of a side entry trap arrangement and gross pollution filter in place.

There exist as described previously a variety of trap arrangements and for the purposes of describing this embodiment of the invention a side entry trap is used. It will be appreciated that the invention may be readily adapted to various other trap types. An example of a side entry trap is depicted in FIGS. 1 and 3.

Figure 1:
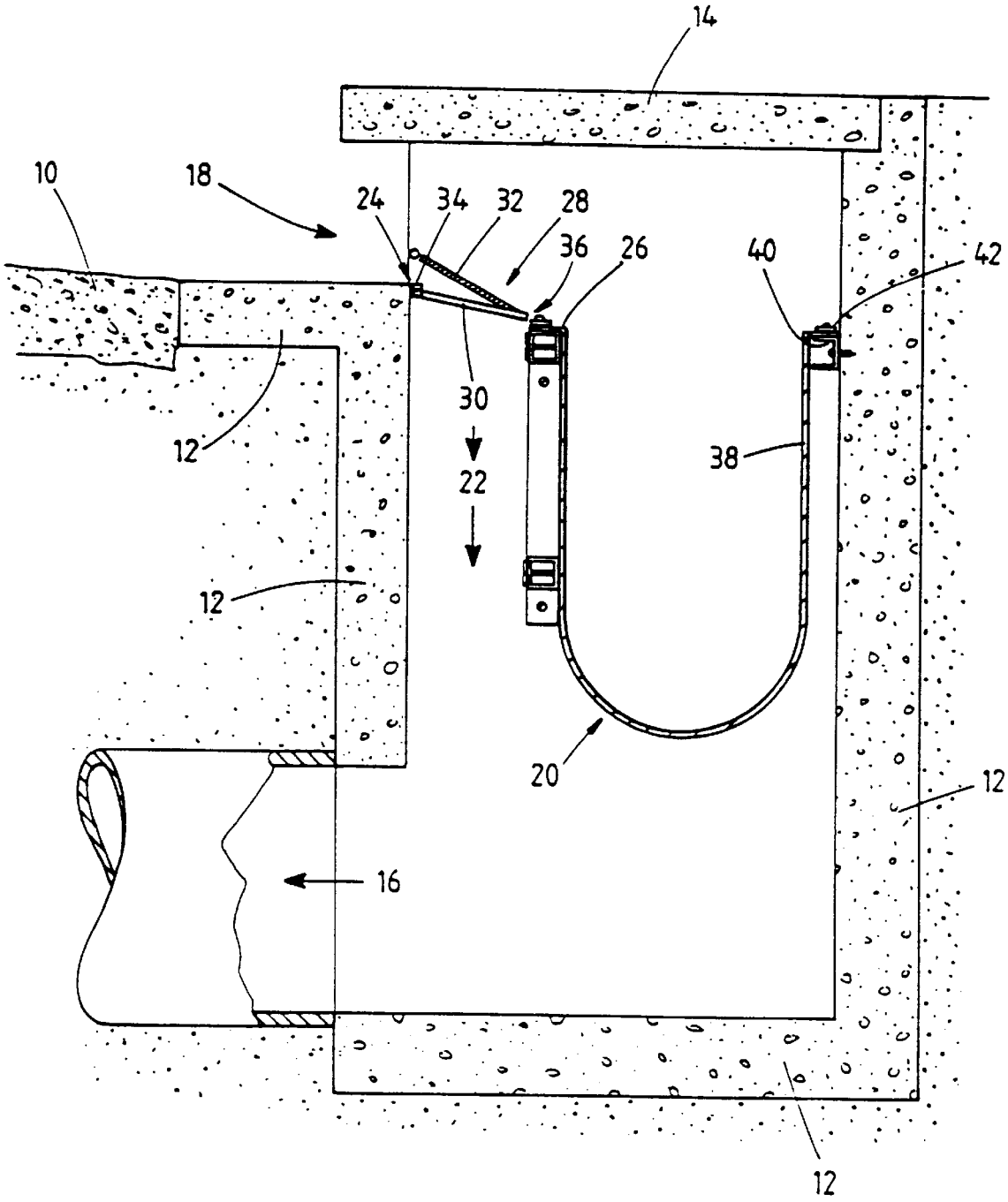
FIG. 1 depicts a side cross-sectional view of a gross pollution filter apparatus according to the invention located in a side entry trap arrangement.

FIG. 1 depicts a road surface 10 adjacent a trap arrangement 12 typically constructed of concrete which is moulded off site and transported for installation or poured into a suitable formwork in situ. The arrangement has a lid 14 which is typically constructed of reinforced concrete. The upper surface of the lid is at footpath level.

Storm water exits the trap arrangement via a passageway 16 which communicates storm water into the underground storm water drainage system.

The storm water road surface run off entry aperture 18 is located on the side of the trap arrangement hence the use of the term side entry pit to describe this particular arrangement.

FIG. 1 depicts a side view of the entry aperture 18 and the maximum possible volume of storm water that may enter the trap arrangement is determined not only by the depicted height but also the width of the trap. A typical proportion of width to height is depicted in FIG. 3.

The gross pollution filter apparatus of this embodiment comprises a filter basket 20 located below and on the opposite side of the entry aperture 18. The filter basket is sized or arranged so that a bypass channel 22 is provided. The bypass channel is sized so that the maximum possible volume of storm water that may enter the pit is capable of passing down the channel 22 in the event that the filter basket 20 is fully occupied by gross pollution and unable to pass any incoming storm water.

The filter basket can be made of any suitable material however for robustness and longevity a stainless steel sheet having a plurality of circular apertures is preferable. The size and shape of the apertures may vary from trap to trap as the size and type of expected gross pollutants vary from trap site to trap site.

The basket is so called because it is used to collect gross pollution, however, it may be configured as a permanent fixture in the trap or it may be made removable for ease of extraction of gross pollutants. Typically, the gross pollution is vacuumed up or removed by hand or with an implement via the entry aperture. Alternatively the lid 14 can be removed and the gross pollution may be extracted through the top of the trap.

It has been found that two monthly extractions of gross pollutants is sufficient to maintain the efficiency of the trap arrangement fitted with a gross pollution filter of the invention. Of course, this will vary dependent on the expected amount of gross pollution to be collected which may require that in certain seasons the traps are emptied more often or following special events when man-made gross pollution levels are high.

The gap between the bottom level 24 of the entry aperture and the top of one side 26 of the filter basket 20 is bridged in this embodiment by a bypass means 28. In a preferred embodiment of the bypass means a flat plate 30 lies substantially in the plane of the storm water when it flows from the road surface into the trap. The absence of apertures in the bypass means assists in preventing the movable action of the bypass means from being obstructed or hindered by gross pollutants.

Figure 2:
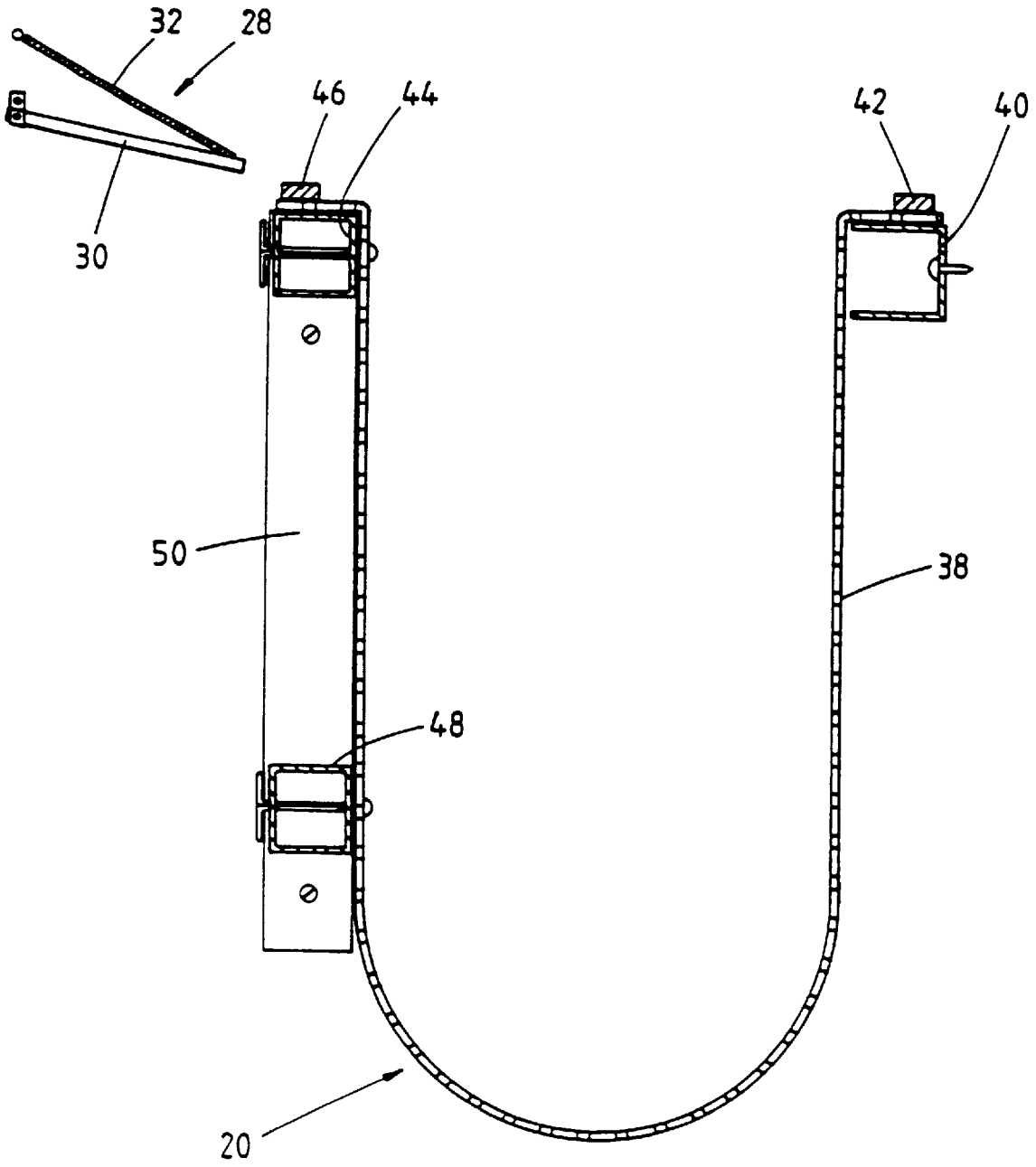
FIG. 2 depicts a cross-sectional view of a gross pollution filter apparatus.

The flat plate 30 is hinged along its width so as to be rotatably movable downwards and in the arrangement depicted in FIGS. 1 to 3 to lie adjacent the internal wall of the trap 12 and thereby allow storm water to access the bypass channel 22 from the filter basket side of the bypass means.

An elastomeric element 32, such as for example a spring, is anchored (not shown) at end 34 and attached to the flat plate 30 at 36, so as to bias the plate into a closed position so as not to allow access of storm water into the bypass channel until sufficient pressure builds up to overcome the bias force of the spring. A stop (not shown) restrains rotation of the plate towards the anchored end of the spring and is located so as to position the plate substantially in the plane of storm water flow between the entry aperture and the filter basket.

Figure 4:
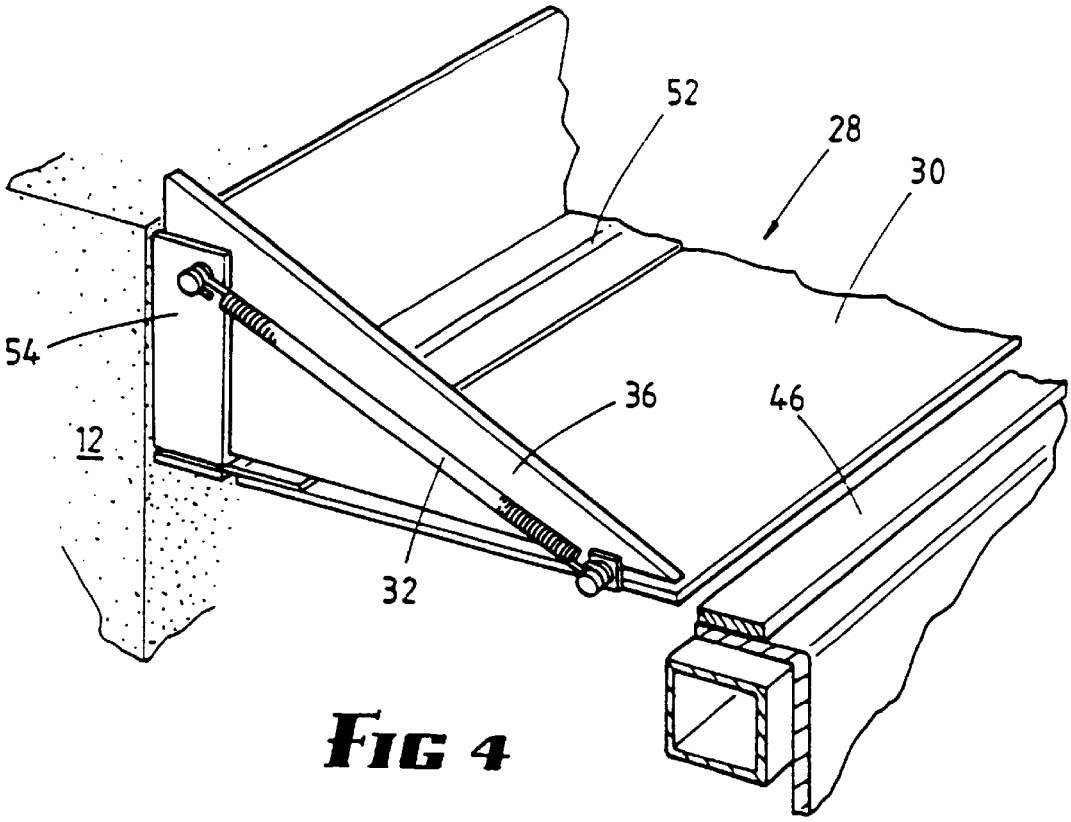
FIG. 4 depicts a storm water bypass means in the form of a pivotable flap shown in a closed (non-bypass) position.
Figure 5:
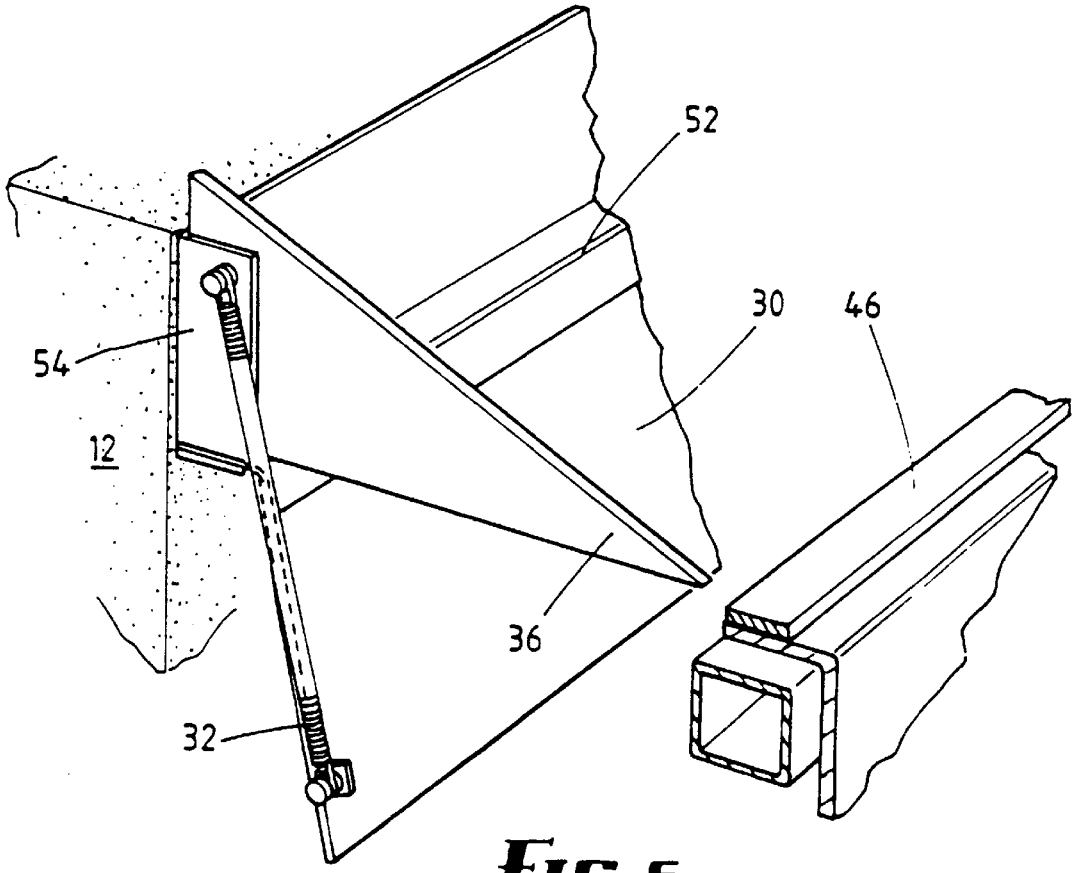
FIG. 5 depicts a storm water bypass means in the form of a pivotable flap in an open (bypass) position.

An embodiment of a bypass means is provided in greater detail in FIGS. 4 and 5.

FIG. 2 depicts in greater detail an embodiment of the filter basket 22 comprising a stainless steel sheet 38 having a plurality of circular apertures therein (not shown). The sheet is adapted to rest upon a support member 40 and affixed thereto by fixing means, for example a pin 42, which stops the sheet sliding off the member but is arranged so that the pin can be extracted from a complementary set of apertures in the sheet and support member so that the basket can be taken from the trap for emptying.

The support member 40 is fixed to the side of the trap as depicted in FIGS. 1 and 3, by fixing means 42, for example a dyna-bolt.

The opposite side of the basket 20 is supported by a second support member 44 which, as does support member 40, extends the width of the trap. The sheet 38 is adapted to rest upon the support member 44 and is fixed thereto by bracket 46.

The depth of the basket into the trap is determined largely by the amount of gross pollutants which are desired to be trapped. As depicted in FIG. 1, the basket is approximately two thirds of the depth of the trap below the road surface level. Conveniently the bottom of the basket is approximately level with the top of the exit aperture of the trap arrangement.

An additional shape supporting bar 48 is located approximately three fifths down the side of the basket adjacent the bypass channel and held at this location by bar 50 which depends from support member 44. This arrangement reduces the deformation of the filter basket into the bypass channel as gross pollution accumulates in the filter basket.

FIG. 3 depicts a perspective view of an in situ entry trap arrangement with a gross pollution filter according to the invention.

FIG. 4 depicts a perspective view of an embodiment of a bypass means 28 comprising a flat plate 30 and a hinge member 52 which may be preferably a nylon tape which is rugged enough to maintain an adequate hinge function in the harsh environmental conditions of its use. An elastomeric element 32 is provided in this embodiment by a spring fixed at one end to the flat plate 30 and at its other end to a framework member 54 which itself is attached adjacent to the entry aperture 18 of the trap arrangement.

The spring biases the flat plate upwards and against stop 36 which in this embodiment is formed by a triangular shaped sheet of metal projecting from the framework member 54.

The bypass means depicted in FIGS. 1 to 5 is of the form described above, however, it is possible for a unitary sheet of plastic having a memory characteristic of its preferred shape to provide a functionally similar arrangement. Such an arrangement is provided by any form of one way valve which closes off the entry to the bypass channel while the filter basket is adequately passing storm water but which opens to allow excess storm water to enter the bypass channel as required.

FIG. 4 depicts the bypass means in a closed position and FIG. 5 depicts a bypass means in an open position. Like elements in the foregoing Figs are identified with like numerals.

Figure 6:
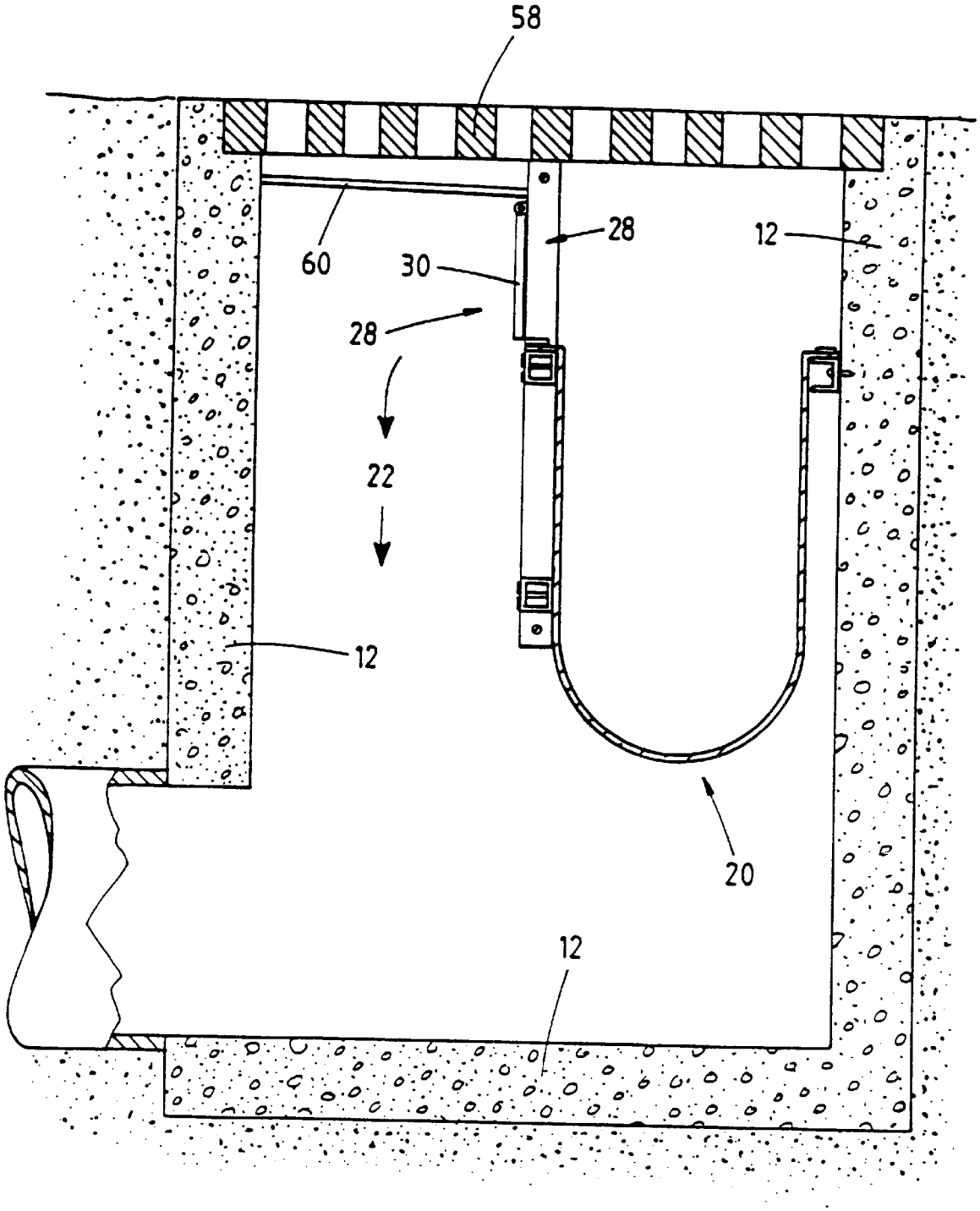
FIG. 6 depicts a side cross-sectional view of a further embodiment of a gross pollution filter apparatus according to the invention having a substantially vertical storm water bypass means.

FIG. 6 depicts a side cross-sectional view of a top entry trap having a grating 58 located at the entry level and aperture of the trap. In most arrangements the grating will act as a primary filter to gross pollutants which results in only a certain size of pollutants being carried into the trap. A diverter member 60 is located under a portion of the grate to direct storm water and any water borne pollutants into the filter basket.

The bypass channel 22 is preferably sized so as to communicate the maximum or a reasonable proportion of the expected volume of storm water collected by the trap.

In this embodiment the bypass means 28 has a vertical orientation and operates in the same manner as that described previously. The flat plate 30 of the bypass means 28 is biased in a closed position until the pressure of storm water on the filter basket side of the bypass means is sufficient to overcome the bias force. The pressure of the storm water moves the flat plate and allows the flow of storm water into the bypass channel 22.

Figure 7:
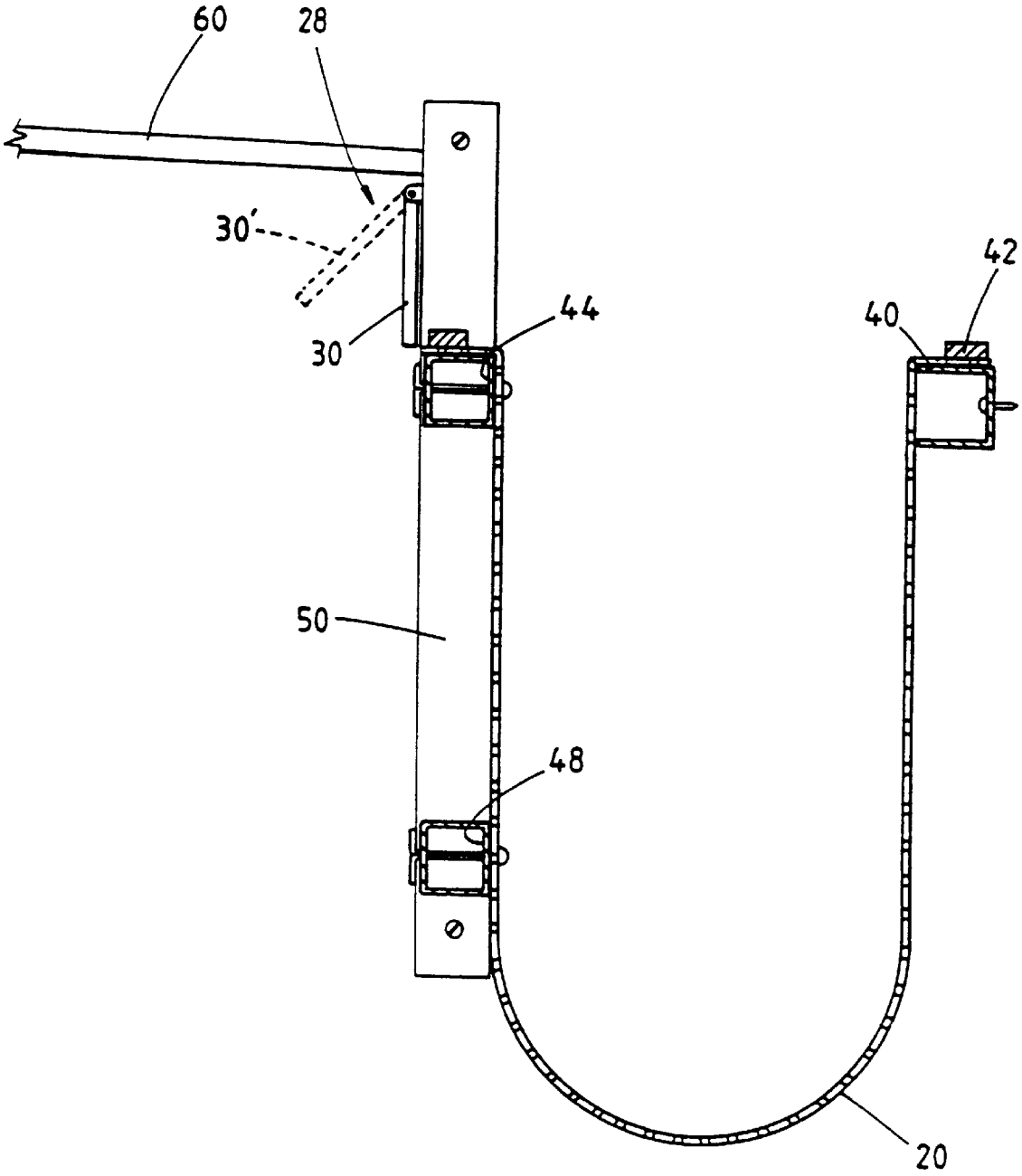
FIG. 7 depicts a side view of a gross pollution filter apparatus.

FIG. 7 depicts like elements of FIG. 6 with like numerals and the dotted outline 30' shows the flat plate in a position to allow overflow of storm water into the bypass channel 22.

The two types of traps described in the specification are merely examples of traps to which the filter apparatus of this invention may be adapted. However, the filter apparatus can be made to suit many other types of traps.

It will be appreciated by those skilled in the art, that the invention is not restricted in its use to the particular application described, nor is it restricted to the feature of the preferred embodiments described herein. It will be appreciated that various modifications can be made without departing from the principles of the invention, therefore, the invention should be understood to include all such modifications within its scope.

We claim:

1. A gross pollution filter apparatus for placement within a trap arrangement used in a storm water drainage system comprising:

a filter basket located below the entry level of the storm water trap arrangement, said basket being adapted to prevent gross pollution passing through said trap arrangement, said basket also being located so as to provide a bypass channel to allow a volume of storm water and gross pollution to pass through said trap arrangement; and a storm water bypass means arranged to restrict entry of incoming storm water and gross pollution into said bypass channel while the combined pressure of storm water and gross pollution inside said trap arrangement is such that storm water can pass through said filter basket but which is also arranged to allow storm water and gross pollution to pass into said bypass channel when the combined pressure of storm water and gross pollution inside said trap arrangement is such that said storm water is restricted from passing through said filter basket.

2. A gross pollution filter apparatus according to claim 1 wherein said storm water bypass means is a one-way valve means.

3. A gross pollution filter apparatus according to claim 1 wherein said water bypass means is a biased pivotable flap member and a stop, said stop positioned to restrict the movement of said flap member.

4. A gross pollution filter apparatus according to claim 1 wherein said filter basket is removable.

5. A gross pollution filter apparatus according to claim 1 wherein said filter basket comprises a unitary sheet material having a plurality of apertures therein and shaped so as to fit across an internal portion of said trap arrangement.

6. A gross pollution filter apparatus according to claim 5 wherein said sheet material is supported at is upper ends by bar members located across the internal width of said trap arrangement.

7. A gross pollution filter apparatus according to claim 6 wherein said sheet material is supported on at least one side intermediate its upper and lower extremities by support means to reduce the deformation of said filter basket into said bypass channel.

8. A gross pollution filter apparatus according to claim 1 wherein said trap arrangement comprises a side entry pit and said filter basket is located in said pit opposite the entry point of storm water and said storm water bypass means is located across said bypass channel which lies between said entry point of storm water and said filter basket.

* * * * *